US005346222A

United States Patent [19]

Luther, Sr.

[11] Patent Number: 5,346,222

[45] Date of Patent: Sep. 13, 1994

[54] GOLF BALL TEEING APPARATUS

[76] Inventor: Walter C. Luther, Sr., Rte. 4, Box 453, Lake City, Fla. 32055

[21] Appl. No.: 44,033

[22] Filed: Apr. 8, 1993

[51] Int. Cl.[5] ..... A63B 69/36; A63B 57/00

[52] U.S. Cl. ..... 273/201

[58] Field of Search ..... 273/201, 33, 26 D, 30, 273/202, 182 R, 191 R, 203; 124/48, 45, 85, 84, 50, 51.1

[56] References Cited

U.S. PATENT DOCUMENTS

| | | | |
|---|---|---|---|
| 1,940,321 | 12/1933 | Pagett | 273/201 |
| 2,171,299 | 8/1939 | Beckett | 273/201 |
| 2,216,853 | 10/1940 | Middleton | 273/201 |
| 3,127,177 | 3/1964 | Benkoe | 273/201 |
| 4,146,232 | 3/1979 | Stone | 273/201 |
| 4,265,453 | 5/1981 | Loof | 273/201 |
| 4,575,092 | 3/1986 | Watson | 273/201 |
| 4,796,893 | 1/1989 | Choi | 273/201 |
| 4,892,318 | 1/1990 | Jennings | 273/201 |
| 4,957,296 | 9/1990 | Turnidge | 273/201 |
| 4,995,614 | 2/1991 | Tange | 273/201 |

FOREIGN PATENT DOCUMENTS

| | | | |
|---|---|---|---|
| 574237 | 3/1933 | Fed. Rep. of Germany | 273/201 |
| 2180762 | 4/1987 | United Kingdom | 273/201 |

OTHER PUBLICATIONS

"Automatic Tee" *Potpourri Holiday Catalog* 1987, p. 74.

*Primary Examiner*—William E. Stoll

*Attorney, Agent, or Firm*—Arthur G. Yeager

[57] ABSTRACT

An apparatus for dispensing one golf ball at a time onto a tee, the apparatus comprising a tubular magazine through which golf balls roll by gravity from an entrance to an exit, a pivotable tubular arm hingedly attached at the exit of the magazine and extending to a dispensing mouth, the arm being biased to hold its mouth at an elevation higher than the magazine exit until manually pivoted downwardly to a dispensing position where the mouth is at a lower elevation than the magazine exit, an adjustable stop screw to prevent balls from rolling out of the exit until the arm is pivoted, means to move one golf ball at a time from contact with the stop screw and allow the ball to roll through the pivotable arm to be dispensed through the mouth onto a tee.

18 Claims, 5 Drawing Sheets

GOLF BALL TEEING APPARATUS

BACKGROUND OF THE INVENTION

Golf driving ranges are a familiar sight to those driving the highways today. A supply of golf balls is purchased by the user who then hits them one at a time from a teeing area into a large open field. If each ball is to be teed up before hitting, the golfer must bend over before each shot to place a ball on a tee, which may be the familiar wooden or plastic tee pushed into the ground, or it may be a flexible rubber tube built into a mat or set permanently in the ground. Many persons who can swing a golf club cannot bend over from the waist to place a ball on a tee. It is for such persons that an automatic teeing apparatus is a necessary device if such practice shots are to be tried. Furthermore, there now are available for home use golf nets that can be set up permitting the golfer to hit into the net with a full swing of the club, and for such purpose an automatic teeing apparatus would be very desirable.

Many such devices have been suggested in tile past employing different systems to provide one teed-up golf ball at a time. One of the most useful systems involves a swinging arm to transfer a golf ball from a reservoir of balls to a tee. Typical of such systems are those described in U.S. Pat. Nos. 4,265,453; 4,796,893; 4,957,296; and 4,995,614. While these have many desirable features, they do not provide the most efficient and useful apparatus that can be devised. Some of the advantages of this invention are as follows:

A. portable and holds at least 25 balls in the magazine;

B. used by anyone on a driving range;

C. can be rented full of balls and taken from the pro shop to the driving range;

D. can be set up easily and quickly to dispense the ball on the tee at the driving range;

E. a rubber mat may cover the base to hold it in place while in use;

F. the golf driving ranges often are concrete with separate places for each person having a mat with a flexible rubber tee to hit the balls therefrom and this device is simply placed on the concrete in front of the mat and centered to dispense the balls on the rubber tee by manually lowering the dispensing head and looking through the open head to see that the tee is centered in the head and the golfer views the ball settling on the tee before releasing the dispensing arm.

An object of this invention is to provide a novel and useful golf ball teeing apparatus. Another object of this invention is to provide a novel apparatus for teeing golf balls with a vertically pivotable arm dispensing the golf ball. Still other objects will become apparent from the more detailed description which follows.

BRIEF SUMMARY OF THE INVENTION

This invention relates to a golf ball teeing apparatus comprising a golf ball dispensing magazine adapted to store a plurality of golf balls and to feed them by gravity one at a time to an exit port, a pivotable tubular arm having a proximal end hingedly attached to the exit port and a distal end having an open mouth for dispensing a golf ball therefrom, the pivotable arm being disposed with the distal end elevated above the proximal end until the distal end is forced downwardly for dispensing a golf ball, a stop means to prevent a golf ball from passing from the exit port into the pivotable arm, and a by-pass means actuated by forcing the pivotable arm downwardly to by-pass the stop means and allow a golf ball to roll to the mouth for being dispensed therefrom.

In specific and preferred embodiments of the invention the magazine is a pipe with a return bend and the magazine is supported in a rigid frame. In another embodiment the stop means includes a screw extending inwardly of the pipe at the exit port, and the by-pass means is an elongated arm with a socket seat attached thereto and positioned under the golf ball adjacent the stop means and adapted to lift that golf ball over the stop means and allow it to roll down the pivotable arm when it is pivoted to a position where the mouth is at a lower elevation than the exit port.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
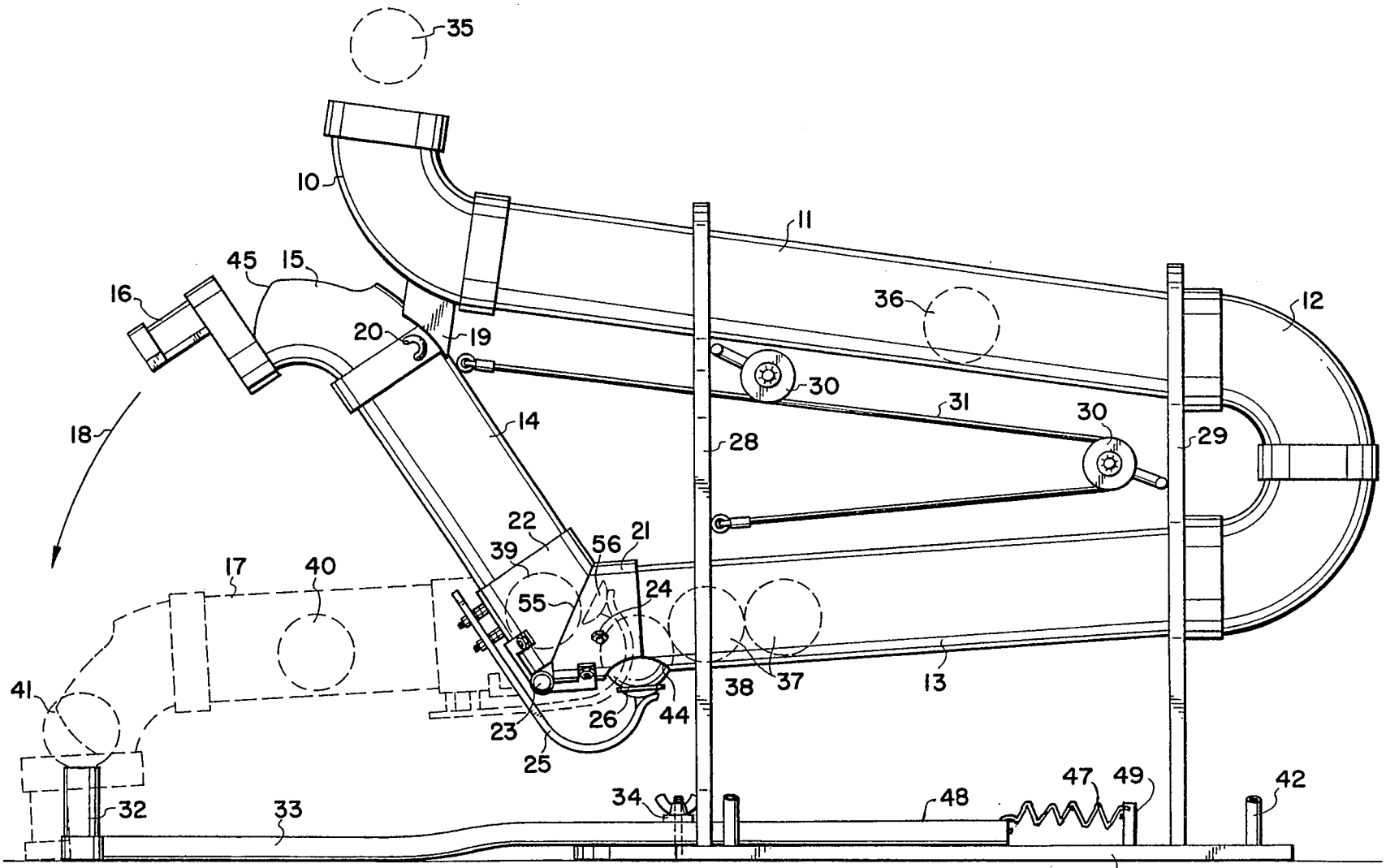
FIG. 1 is a side elevational view of the apparatus of this invention.
Figure 3:
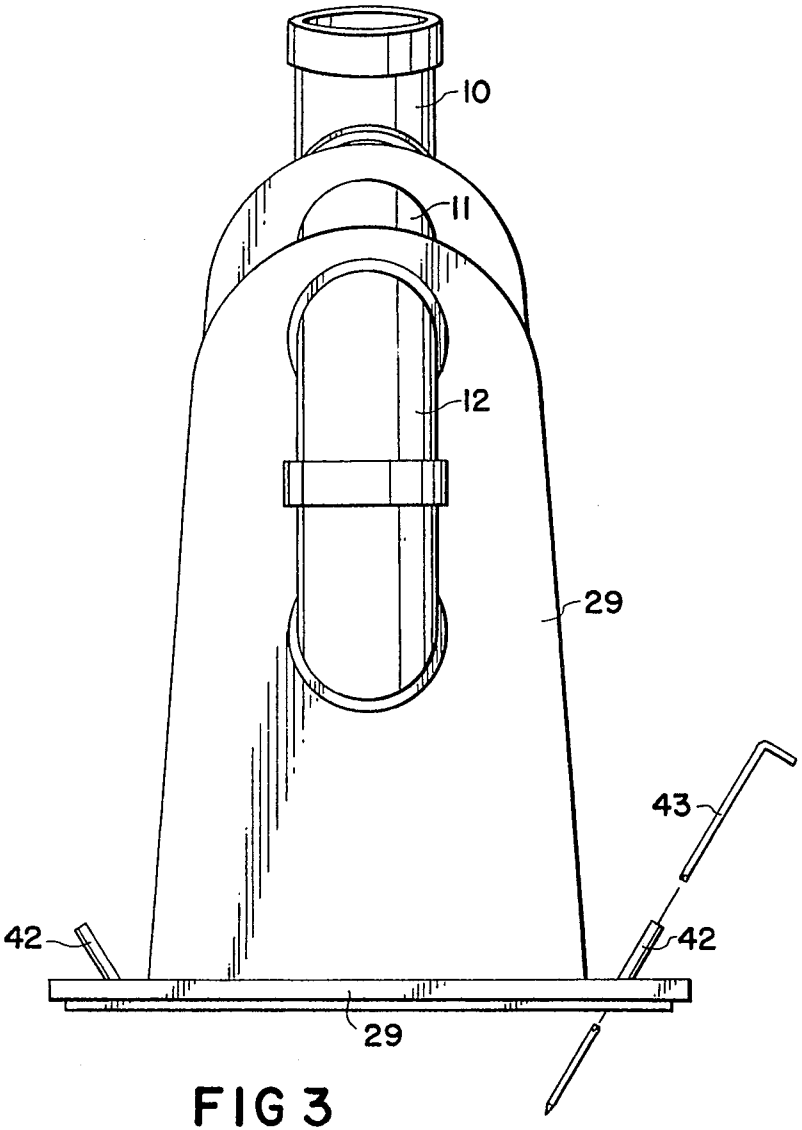
FIG. 3 is a rear elevational view of the apparatus of this invention.
Figure 2:
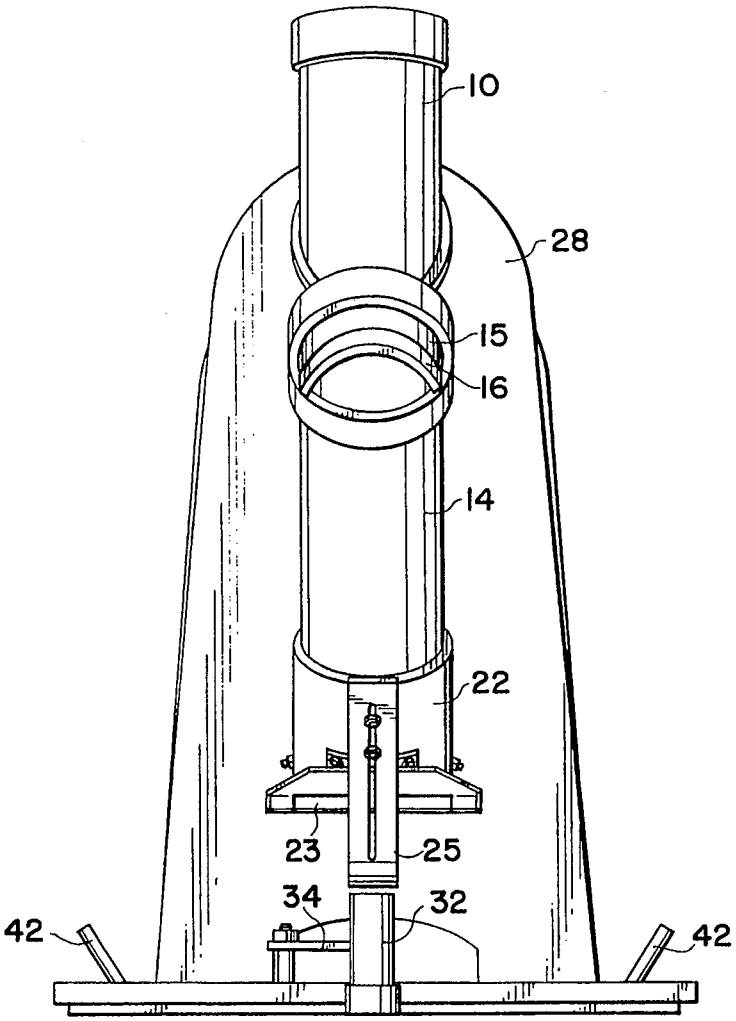
FIG. 2 is a front elevational view of the apparatus of this invention.
Figure 4:
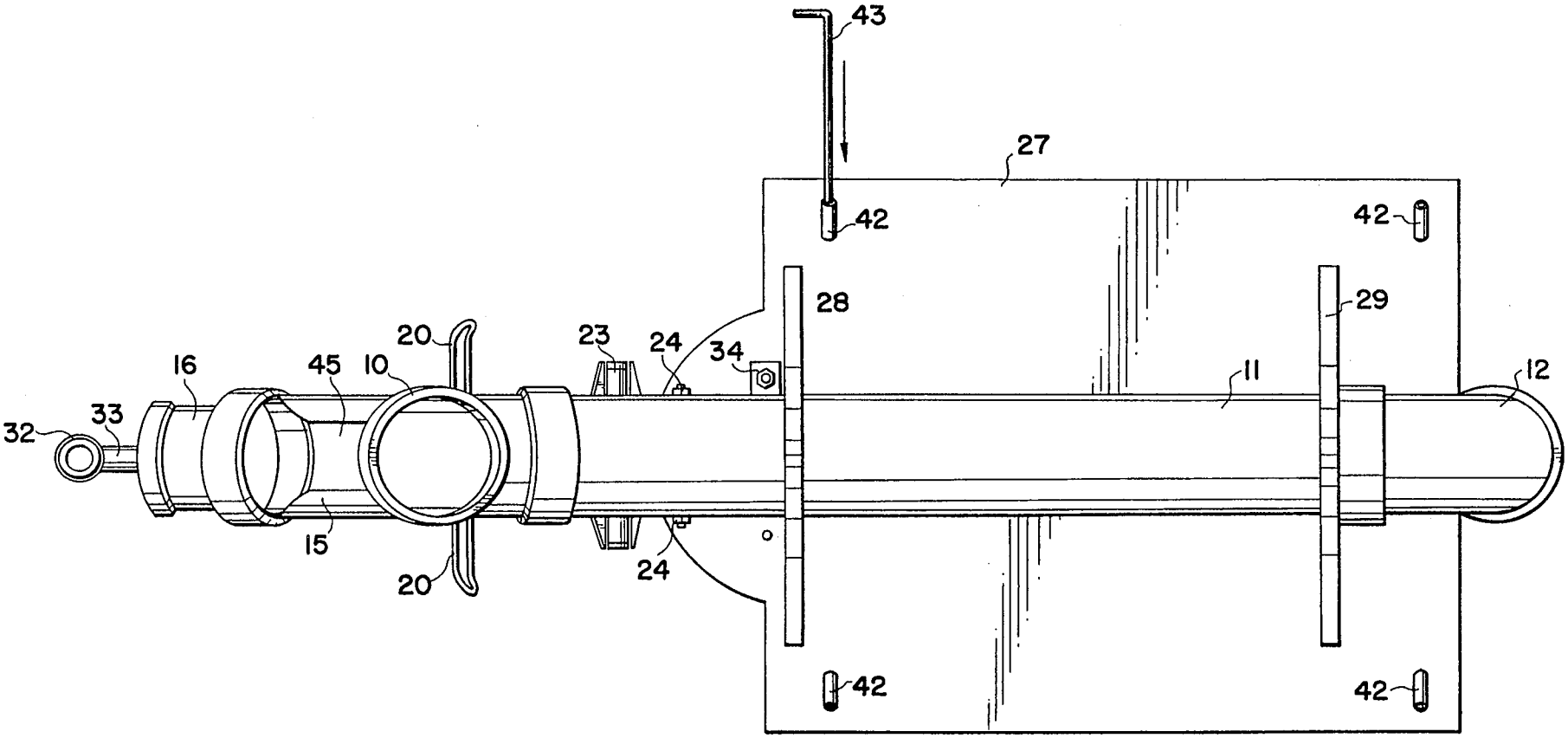
FIG. 4 is a top plan view of the apparatus of this invention.
Figure 5:
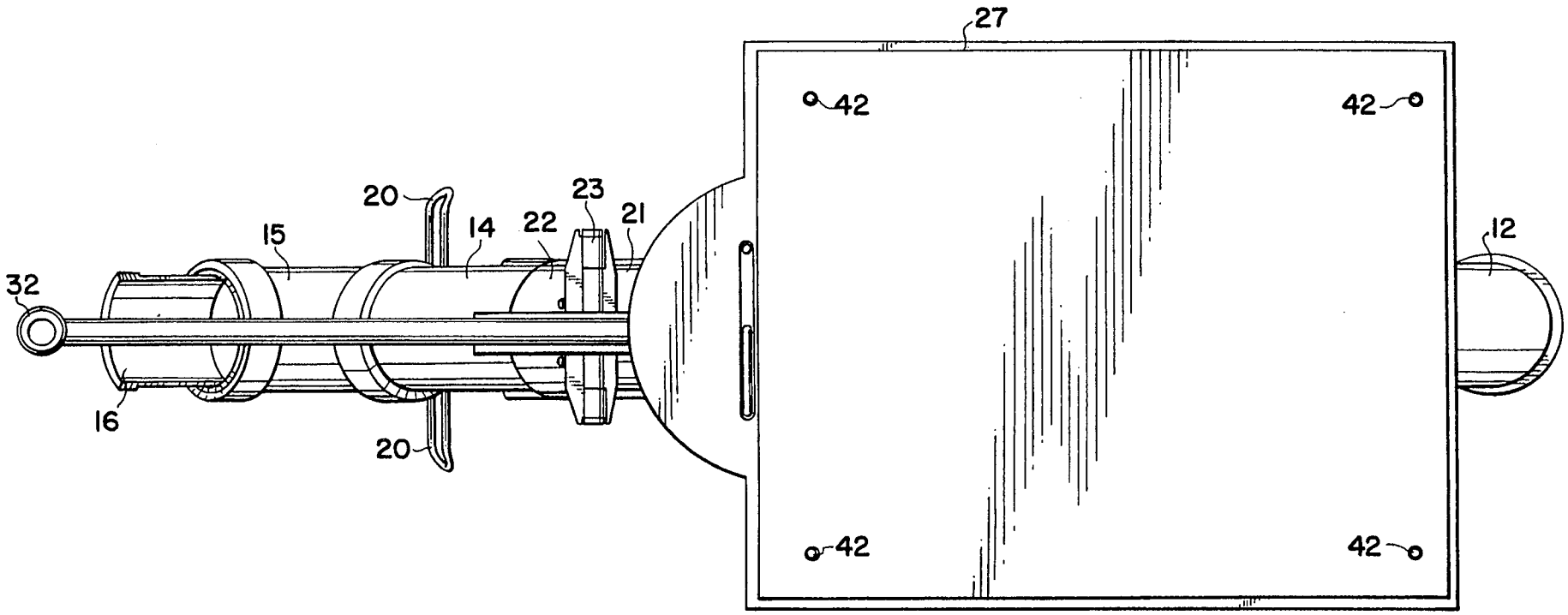
FIG. 5 is a bottom plan view of the apparatus of this invention.

The various features of the apparatus of this invention are best understood by reference to the attached drawings. In FIGS. 1–5 there are shown several views of the apparatus. The basic components of this invention include a storage magazine 10–13 for golf balls and a pivotable arm 14 to allow one golf ball 41 to be placed on a tee 32 when arm 14 is pivoted downwardly in the direction of arrow 18. The magazine is preferably made of plastic pipe, such as polyvinylchloride pipe and includes an entrance ell 10, an upper pipe 11, V-bend 12, and lower pipe 13. At the lower end of pipe 13 is a sleeve 21 serving as the exit port of the storage magazine section. Pipe 14 is a pivotable member having at its proximal end sleeve 22 and at its distal end a mouth where a golf ball may be dispensed with nose guide 16 directing the golf ball 41 onto a tee 32. The pivotable arm includes an ell 15 to turn the ball 40 downward in its rolling movement when the arm reaches its down position 17 for dispensing the ball onto tee 32. The nose guide 16 also functions as a stop that restricts the pivoting of arm 14. Preferably guide 16 is removable and may be of various lengths to accommodate various heights of flexible tees.

It may be seen that pipe 14 is in its up position as shown in solid lines and in its down position 17 as shown in dashed lines. In the up position sleeves 21 and 22 meet along a miter angle plane 55 and are joined by hinge 23 to provide the support for the pivotal movement of arrow 18. Arm 14 is biased to its up position by any suitable means. The means shown in FIG. 1 is an elastic bungee cord 31 guided by pulleys 30 and fastened at the forward end to arm 14 and at the rearward end to frame member 28 which is immovable with respect to arm 14. Arm 14 is pivoted by manual pressure applied to ears 20 projecting outwardly from both sides of arm 14. It is expected in normal usage that a golfer using the apparatus of this invention will be standing to the left of tee 32 in FIG. 1 and will merely push downwardly on ear 20 with his golf club in order to dispense a golf ball onto tee 32. To prevent noise and damage to the apparatus it is preferred to position an impact-absorbing pillow 19 to prevent elbow 15 from banging into elbow 10 when the golfer releases his downward pressure on ear 20. Pillow 19 may be a plastic or rubber foam or other shock absorbing material.

The golf ball storing and dispensing members are supported in a rigid frame comprising a horizontal base 27 and two spaced vertical braces 28 and 29 having holes therein to receive pipes 11 and 13 extending therethrough. Base 27 may simply rest on the teeing ground or it may be temporarily pinned in place to prevent movement. Tubes 42 pierce base 27 and spikes 43 are pushed through tubes 42 into the underlying earth to pin the apparatus into a rigid position. When spikes 43 are removed the apparatus may then be moved to another location.

The apparatus includes a stop means to prevent the string of golf balls from freely rolling past the exit port at sleeve 21. The stop means shown here are two screws and nuts 24 which pierce the wall of sleeve 21 and pipe 13 inside sleeve 21. The heads of these screws extend inwardly into the path of the golf balls approaching the exit port and prevent each ball as it contacts stop screws 24 from rolling any farther forward. Screws 24 are adjustable as to length and can therefore, be set to extend inwardly the minimum necessary to function as stops.

The by-pass means is a system for allowing one ball at a time to proceed from stop screws 24 on to roll through lower pipe 14 to be dispensed through the mouth at nose guide 16. By-pass means shown here includes lever arm 25 which is rigidly attached to sleeve 22 and pipe 14 to move as pipe 14 is pivoted around hinge 23. At the free end of lever arm 25 is a lifting cup or socket seat 26, which is preferably pliable and which has the general contour of a golf ball, and will readily serve as a concave seat for a golf ball. Pipe 13 and sleeve 21 are pierced by a cut-out hole 44 so that socket seat 26 can contact of golf ball 38 which has been stopped by stop screws 24. When pipe 14 is in the up position as shown in solid lines in FIG. 1, socket seat 26 is just touching golf ball 38 supporting it in generally the same position it would be if there were no hole 44 there. When pipe 14 is pivoted downwardly to position 17, socket seat 26 moves to the by-pass position 56 (shown in dotted lines in FIG. 1) lifting golf ball 38 over stop screws 26 and releasing it to golf ball position 39 from whence it will roll to position 40 and then to 41 as pipe 14 is lowered in the direction of arrow 18 until mouth and nose guide 16 are at a lower elevation than exit port and sleeves 21 and 22 whereupon gravity will roll the golf ball to the mouth to be dispensed.

The by-pass means basically accomplishes two results. First, it dispenses the ball on socket seat 26 into the arm 14 while at the same time holding back the following balls in the magazine 10–13. This is the primary reason that the by-pass means was constructed with the curved end 25 beneath the socket seat 26 to hold back the following balls without forcing them back in the magazine. The lifting cup or socket seat is preferably pliable to inhibit jamming of the balls as they are not always the exact same size, etc.

There are two tees shown in these drawings. In FIGS. 1, 2, 4 and 5, tee 32 is shown at the end of elongated connector 33, which, in turn, passes through clamp 34 which permits movement of connector 33 in the event tee 32 is hit by a club together with the ball thereon. A return spring 47 engages between the rear end 48 of arm 33 and a support 49 affixed to base 27. There are, of course, times when the golfer does not wish to use a tee, and instead wants the golf ball to be directly on the turn. This is accomplished by merely removing the wing nut, unhooking spring 47, and tee 32 and arm 33 and simply placing aside. When used with the built-in rubber tee on conventional mats, the arm 33, etc., is not used.

Figure 6:
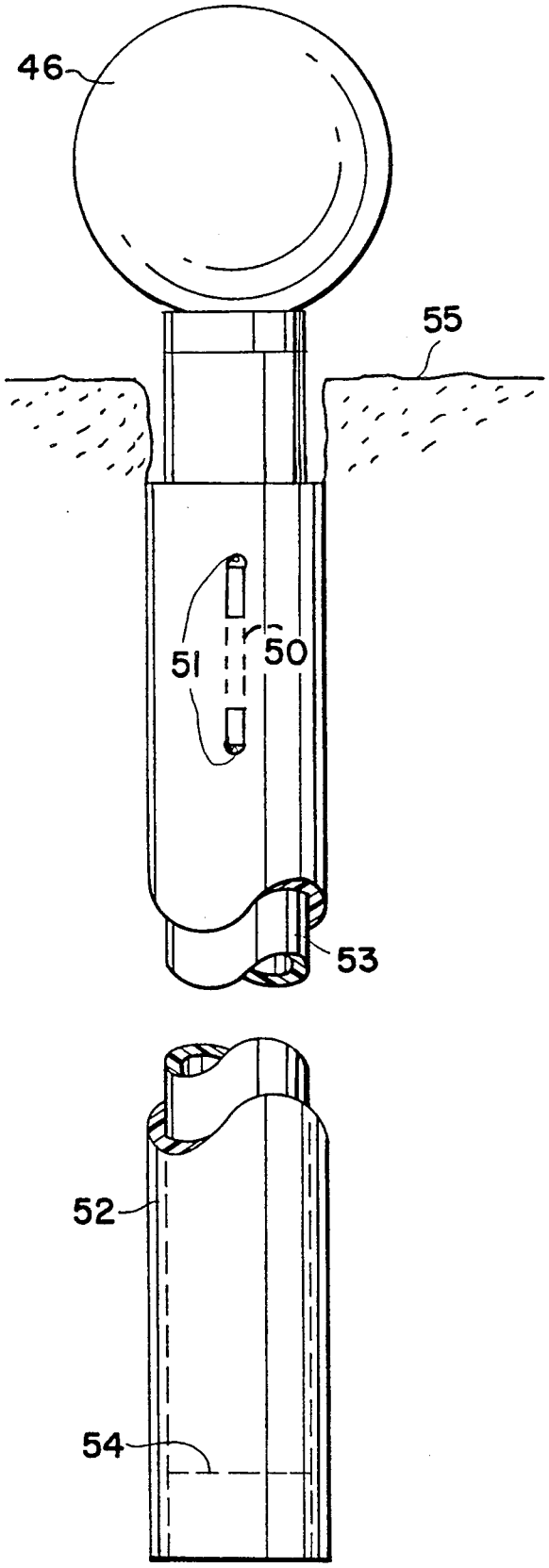
FIG. 6 is a front elevational view of a second embodiment of a tee used with this invention.

Another tee is shown in FIG. 6 wherein an outer rigid tube 52 has a plug 54 at its bottom and an inner tube 53, which is flexible, is slidingly disposed within outer tube 52. A small leaf spring 50, disposed inwardly and attached to spaced holes 51 in outer tube 52, engages against inner tube 53 to provide increased resistance to sliding movement of the inner tube 53 within the outer tube 52; i.e., to maintain the desired height of the inner tube above the ground level 55. As seen, the rigid outer tube 52 is approximately one inch below ground level to inhibit any contact by the golf club hitting ball 46, while permitting contact with the flexible tube 53. Golf ball 46 rests on flexible tube 53. This embodiment in FIG. 6 is designed to be placed permanently in the ground rather than movable as described with respect to FIG. 1. Of course, if needed, the inner tube 53 may be lowered to cut the grass and then pulled back up to its previous position. A drill or pipe tool can be pounded into the ground with a mallet and then removed so as to provide a suitable hole to receive the tee member of FIG. 6.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A golf ball teeing apparatus comprising a base and a golf ball dispensing magazine mounted to said base and adapted to store a plurality of golf balls and feed them by gravity one at a time to an exit port, a pivotable tubular arm having a proximal end and a distal end and being hingedly attached at said proximal end to said exit port and having an open mouth at said distal end for dispensing a golf ball therefrom, said mouth being adapted and arranged to deposit a golf ball being discharged from said mouth onto a tee centered with respect to said mouth, automatic stop means at said exit port for preventing a golf ball from freely passing into said pivotable arm when it is pivoted downwardly, and by-pass means actuated by moving said pivotable arm downwardly to permit one golf ball to by-pass said stop means and roll to said mouth.

2. The apparatus of claim 1 wherein said pivotable arm is a length of pipe through which a golf ball can roll.

3. The apparatus of claim 1 wherein said mouth has a discharge opening directed downwardly.

4. The apparatus of claim 1 further comprising a tee connected to a movable arm and a return spring connected between said movable arm and said base to return said tee to its centered position with respect to said mouth.

5. The apparatus of claim 1 wherein said pivotable arm is spring biased to a position where said mouth is at an elevation higher than the elevation of said exit port.

6. A golf ball teeing apparatus comprising a base and a golf ball dispensing magazine mounted to said base and adapted to store a plurality of golf balls and feed them by gravity one at a time to an exit port, a pivotable tubular arm having a proximal end and a distal end and being hingedly attached at said proximal end to said exit port and having an open mouth at said distal end for dispensing a golf ball therefrom, said mouth being adapted and arranged to deposit a golf ball being discharged from said mouth onto a tee centered with respect to said mouth, automatic stop means at said exit port for preventing a golf ball from freely passing into said pivotable arm when it is pivoted downwardly, and by-pass means actuated by moving said pivotable arm downwardly to permit one golf ball to by-pass said stop means and roll to said mouth, said automatic stop means including a stop screw which is adjustable to project into a path of a golf ball at said exit port.

7. The apparatus of claim 6 wherein said by-pass means additionally includes a cut-out portion on the lower side of said exit port where said golf ball rests against said stop screw, a socket seat at said cut-out portion positioned to receive in the socket a golf ball adapted to rest against said stop screw, said socket seat being attached to an extension arm which is attached to said pivotable arm such that as said pivotable arm is pivoted downwardly said socket seat projects into said exit port lifting a golf ball resting thereon above said stop screw and into said pivotable arm to roll to said mouth and inhibit movement of following golf balls until said pivotable arm returns.

8. A golf ball teeing apparatus comprising a tubular magazine through which golf balls can roll freely from an elevated entrance into which golf balls can be fed one at a time to a lower exit out of which golf balls can exit one at a time, a pivotable tubular having a proximal end and a distal end with said proximal end hingedly connected to said lower exit and said distal end automatically held in a more elevated position than said proximal end until pushed downwardly to dispense a golf ball, stop means at said lower exit for preventing a golf ball from freely rolling past said lower exit, by-pass means for permitting a golf ball at said stop means to be freed from said stop means and to roll to said distal end of said pivotable tubular arm onto a tee adapted to be positioned to receive thereon a golf ball rolling out of said distal end, and a support frame for holding said magazine in position to insure gravity rolling of golf balls through said magazine said stop means including an adjustable stop screw projecting inwardly of said magazine adjacent said lower exit.

9. The apparatus of claim 8 wherein aid by-pass means includes a cut-out portion on the lower side of said lower exit at the position of a golf ball resting against said stop screw, a socket seat in said cut-out portion supporting said golf ball resting against said stop screw, said socket seat being attached to an elongated curved extension arm attached to said pivotable tubular arm in a position such that, when said pivotable tubular arm is pivoted to swing said distal end downwardly towards said tee, said socket seat pushes a golf ball resting against said stop screw over said stop screw and into said pivotable tubular arm permitting it to roll to said distal end when said distal end is pivoted to an elevation below said proximal end.

10. The apparatus of claim 8 wherein said distal end is held automatically at a higher elevation than said proximal end by a system of pulleys and spring means biasing said distal end to a higher elevation than said proximal end when there are no counter-acting manual forces holding said distal end down.

11. The apparatus of claim 8 further comprising a tee located at the end of an elongated arm movably supported by said frame.

12. The apparatus of claim 8 wherein said distal end includes cut-out portions to enable sighting and centering of said distal end onto a tee and of a golf ball rolling to said distal end so as to prevent inadvertent release of said distal end until after a golf ball is seated onto a tee.

13. A portable golf ball teeing apparatus comprising a base, a golf ball dispensing magazine mounted to said base adapted to store a plurality of golf balls and feed each ball by gravity to an exit port, an elongated arm having a proximal end and a distal end, connecting means for hingedly attaching said proximal end to said magazine adjacent said exit port, said arm having an open mouth at said distal end for dispensing a golf ball therefrom, said mouth being adapted to be centered with respect to a tee to receive a golf ball thereon as that golf ball traverses said arm and is discharged from said mouth, actuating means including automatic means carried by said elongated arm adjacent said exit port for preventing a golf ball in said magazine from freely rolling from said exit port into said elongated arm when it is pivoted downwardly, said actuating means further including ejector means actuated by moving said arm downwardly from said connecting means to forcibly engage and move one golf ball upwardly and to eject same from said exit port into said elongated arm to permit it to roll down said elongated arm to said mouth to deposit same on a tee.

14. The apparatus of claim 13 wherein said magazine is a length of elongated pipe having an elongated axis and a passageway therethrough and at least one reverse bend, said pipe and bend being in the same general plane and having a size that golf balls will easily roll in series through said passageway without clogging.

15. The apparatus of claim 13 further comprising spring biasing means connected to said elongated arm to position said mouth at an elevation higher than the elevation of said exit port when said elongated arm is at rest.

16. The apparatus of claim 15 wherein said actuating means additionally includes a cut-out portion on a lower side of said magazine adjacent said exit port where a single golf ball rests prior to being ejected, said ejector means including a seat at said cut-out portion positioned therebeneath and an extension arm connected between said elongated arm and said seat, said seat moving a golf ball resting in said cut-out portion accurately as said elongated arm is pivoted downwardly with said seat projecting into said cut-out portion and toward said exit port lifting golf ball into said elongated arm to roll down said elongated arm to said mouth.

17. The apparatus of claim 16 further comprising stop means to prevent a golf ball to roll past said exit port without being ejected by said socket seat.

18. The apparatus of claim 16 wherein said stop means includes a pair of spaced stop screws which are adjustable to project into the path of a golf ball and being located between said cut-out portion and said exit port, said seat lifting a ball thereon above said stop screws to eject a ball from said exit port into said elongated arm, said ejector means including means to inhibit movement of following golf balls in said magazine until said seat is moved and repositioned generally below said cut-out portion.

* * * * *